United States Patent [19]

Lyons et al.

[11] Patent Number: 4,707,435

[45] Date of Patent: Nov. 17, 1987

[54] INDUSTRIAL X-RAY SYSTEM

[75] Inventors: Thomas D. Lyons, St. Paul; Peter B. Jamieson, Woodbury, both of Minn.

[73] Assignee: Minnesota Mining and Manufacturing Company, St. Paul, Minn.

[21] Appl. No.: 484,518

[22] Filed: Apr. 13, 1983

Related U.S. Application Data

[63] Continuation-in-part of Ser. No. 267,402, May 26, 1981, abandoned.

[51] Int. Cl.[4] ..... G03C 5/17; G03C 1/92

[52] U.S. Cl. ..... 430/494; 430/506; 430/507; 430/966; 250/475.2

[58] Field of Search ..... 430/966, 494, 506, 507; 250/475

[56] References Cited

U.S. PATENT DOCUMENTS

| | | | |
|---|---|---|---|
| 3,705,858 | 12/1972 | Luckey et al. | 252/301.4 S |
| 3,725,704 | 4/1973 | Buchanan et al. | 250/71 R |
| 3,753,714 | 8/1973 | Sugiyama et al. | 430/139 |
| 3,912,933 | 10/1975 | Van Stappen | 250/475 |
| 3,922,545 | 11/1975 | Gibbons et al. | 250/303 |
| 4,049,454 | 9/1977 | Van Doorselaer et al. | 430/505 |
| 4,130,428 | 12/1978 | Van Doorselaer | 430/966 |
| 4,130,429 | 12/1978 | Van Doorselaer et al. | 430/966 |
| 4,177,071 | 12/1979 | DeBrabandere et al. | 430/494 |

FOREIGN PATENT DOCUMENTS

| | | |
|---|---|---|
| P232661 | 5/1972 | Fed. Rep. of Germany . |
| 1565811 | 4/1980 | United Kingdom . |

OTHER PUBLICATIONS

Selman, The Fundamentals of X-ray and Radium Physics, 1979, Charles C. Thomas, publisher, Springfield, Ill., pp. 336–337.

Warren J. McGonnagle, Nondestructive Testing, Second Edition, pp. 119–123, published by Gordon and Breach.

"An Alternative Approach to Industrial Radiography", P. Broadhead, Jour. Phot. Sci., vol. 29, 1981, pp. 103–110.

*Primary Examiner*—Won H. Louie

*Attorney, Agent, or Firm*—Donald M. Sell; James A. Smith; Mark A. Litman

[57] ABSTRACT

Industrial radiographic systems having low grainines and high information density may be constructed with intensifying screens sandwiching radiation sensitive elements having emulsions wherein the average size of the silver halide grains is less than 0.4 micrometers.

9 Claims, No Drawings

INDUSTRIAL X-RAY SYSTEM

This is continuation-in-part of application Ser. No. 267,402, filed May 26, 1981, abandoned.

FIELD OF THE INVENTION

This invention relates to a novel, high definition, industrial radiographic system. The system uniquely combines fine grain silver halide emulsion photographic film and a light-emitting phosphor screen.

BACKGROUND OF THE ART

Nondestructive testing of articles and materials has become an integral part of quality control in modern manufacturing industries. This type of testing enables on-line and intensive evaluation of the structural soundness of products. One of the most commonly used forms of nondestructive testing is radiographic images taken on industrial materials. Industrial X-rays have been used for many years in the testing of support beams used in the construction of buildings, bridges and the like. They are particularly useful in the evaluation of welds and in testing metal plates for minute flaws which could affect performance.

As industrial demands on materials become more stringent and the tolerance for flaws becomes reduced, more precise testing methods are required. In all imaging processes, including photography and radiography, there is an inherent limit in the resolution available through the process because of the physical elements used. In the practice of modern industrial X-ray procedures, the use of intensifying screens adds a further limit on the resolution available in radiographs. It has heretofore been generally accepted that the phosphor grains in intensifying screens and the screens themselves were the limiting factor in the graininess or resolution available in radiographs used in nondestructive testing (cf. *Nondestructive Testing,* 2d Ed. Warren J. McGonnagle, Science Publishers, 1971, pages 119–123, *Radiography in Modern Industry,* 3d Ed., Eastman Kodak, 1969, pages 34–38, and *Physics of Industrial Radiology*, R. Halmshaw, London, Heywood Books, 1966, pp. 110 and 176). This limitation was believed to be a result of the fact that visible radiation emitted from the phosphor grain is spread out rather than projected in a linear path like the incident X-rays.

Radiographic emulsions used in industrial screen/-film X-ray procedures typically have emulsions where the average grain size is above 0.5 micrometers (e.g., U.S. Pat. No. 3,922,545, col. 13, lines 25–46) and generally over 1 micrometer (e.g., U.S. Pat. No. 3,753,714, col. 4, lines 34–40). U.S. Pat. Nos. 4,177,071 and 4,130,428 discloses a range of 0.25 to 1.2 micrometers for the grain size, but the examples are only of emulsions having average grain sizes of 0.5, 0.6, 0.7 and 0.8 micrometers.

Furthermore, these patents show color photographic emulsions, wide distribution of grain size, high coating weights of silver halide, low contrast values, and low optical densities.

SUMMARY OF THE INVENTION

An imageable system particularly useful for industrial X-ray procedures comprises at least two X-ray intensifying screens having a radiation sensitive photographic film between the screens. The film comprises a base with a decolorizable (e.g., bleachable or solvent removable in aqueous alkaline solvent) dye underlayer on at least one side of the base and two radiation sensitive silver halide emulsion layers, one on each side of the base (with at least one over the dye underlayer). The silver halide emulsions are comprised of dye sensitized silver halide grains having a number average size of less than 0.40 micrometers and greater than 0.05 micrometers with a size distribution amongst the grains so that at least 75% by number of all grains are within 0.07 micrometers of the average grain size. The emulsion must also provide a contrast of greater than 4.0 at an optical density of 2.0 and provide a $D_{max}$ of at least 3.5. A coating weight of less than 10 g/m$^2$ of silver halide in each emulsion is preferred. The systems should also have a covering power of greater than 100. The grains are preferably sensitized to a portion of the spectral region near that of the light emitted by the phosphor screen.

DETAILED DESCRIPTION OF THE INVENTION

The present invention concerns itself with radiographic imaging systems comprising two X-ray intensifying screens sandwiching a radiation sensitive element, said element comprising:

(1) a base,
(2) a decolorizable dye underlayer on at least one side of said base,
(3) a first silver halide emulsion over said dye underlayer, and
(4) a second silver halide emulsion on the other side of said base.

Both of the silver halide emulsions, although not necessarily identical, must have silver halide grains with an average size of less than 0.40 micrometers and larger than 0.05 micrometers with a size distribution amongst the grains so that at least 75% by number of all grains are within 0.07 micrometers of the average grain size. The emulsion must also provide a contrast of greater than 4.0 at an optical density of 2.0 and provide a $D_{max}$ of at least 3.5. A coating weight of less than 10 g/m$^2$ of silver halide in each emulsion is preferred. The systems should also have a covering power of greater than 100. Preferably the average size is between 0.075 and 0.35 micrometers and most preferably between 0.10 and 0.25 or even 0.20 micrometers. The emulsion should provide a black-and-white image and there should be a substantial absence of color couplers in the emulsion (that is, less than 0.05 moles of coupler for each mole of silver halide). Preferably the films can provide a $D_{max}$ of at lest 4.0 with a coating weight of less than 8 g/m$^2$ of silver halide in each emulsion. Also preferably, the grain size distribution should be such that at least 85% of the total number of grains should be within 0.05 micrometers of the average grain size. The silver halide grains should be sensitized to light emitted by the intensifying screens when struck by X-rays. Dye sensitization of the silver halide is well understood in the art. Upon determination of the emission spectrum of the particular phosphor selected, one can readily select sensitizing dyes which are known to sensitize silver halide crystals to the appropriate region of the spectrum, usually between 400 and 780 nanometers. Preferably the silver halide is sensitized to a spectral range within 25 nanometer of the maximum wavelength emission of the screen ($\lambda$max), more preferably within 15 nm, and most preferably within 10 nm.

The present invention also relates to a process for taking industrial radiographic images of industrial materials. In the practice of the present invention, 'industrial materials' are defined as all items or artifacts other than life forms. Industrial materials of metals, alloys, ceramics, glass, and polymeric resins (organic and inorganic) in the form of sheets, films, art forms, staple articles, intermediate and completed structures, and other forms are contemplated in the practice of the present invention.

Conventional industrial radiographic processes and materials utilize emulsions having a high concentration of silver which is used to absorb X-rays. Some of the consequences of using these high concentrations of silver include long processing times (e.g., in the neighborhood of ten to twelve minutes), long drying times, and high material costs.

Radiographic emulsions used in the practice of the present invention should have silver coating weights less than 10 g $Ag/m^2$ and preferably between 3 and 8 grams of silver per square meter. The most preferred range is between 3 and 7 $g/m^2$ of silver. These films have enabled complete processing times to be reduced to as little as ninety seconds.

The process would be performed by using a conventional X-ray projection source or other high energy particle radiation sources including gamma and neutron sources. As well known in the art, the particular phosphor used should have a high absorption coefficient for the radiation emitted from the source. Usually this radiation is high energy particle radiation which is defined as any of X-rays, newtrons and gamma radiation. The industrial material would be placed between the controllable source of X-rays and the industrial radiographic system of the present invention. A controlled exposure of X-rays would be directed from the source and through the industrial material so as to enter and impact the radiographic system at an angle approximately perpendicular to the plane or surface of the intensifying screen and the photographic film contiguous to the inside surface of the screen. The radiation absorbed by the phosphors of the screen would cause light to be emitted by the screen which in turn would generate a latent image in the two silver halide imaging layers. Conventional development processes including stop baths, washes, fixing, bleaching and the like would then be used on the exposed film.

The silver halide grains may be selected from amongst any of the known photographic silver halide materials such as silver chloride, silver bromide, silver iodide, silver bromoiodide, silver chlorobromoiodide, silver chlorobromide, and the like and mixtures thereof.

The vast list of known photographic adjuvants and processing aids may be used in the practice of the present invention. These materials include gelatin extenders, chemical sensitizers (including sulfur and gold compounds), development accelerators (e.g., onium and polyonium compounds), alkylene oxide polymer accelerators, antifoggant compounds, stabilizers (e.g., azaindenes especially the tetra- and pentaazaindenes), surface active agents (particularly fluorinated surfactants), antistatic agents (particularly fluorinated compounds), plasticizers, matting agents, hardening agents, hardening accelerators, and the like.

The base may be any one of the well known photographic support materials such as glass, polymeric films such as cellulose acetate (and triacetate), polyesters (particularly polyethyleneterephthalate), polycarbonates, polystyrene, and polyvinyl acetal film base. Many other materials may also be used.

The dye underlayer must contain a decolorizable dye. By the term 'decolorizable', it is meant that the light absorbing ability of the dye must be substantially diminishable or capable of being completely removed. For example, the dye in the binder which forms the underlayer may be readily soluble in aqueous alkaline solutions used in the processing (developing) of the film element so that the dye would be washed out of the element. The dye could be alkaline solution bleachable, heat bleachable, sulfite bleachable, or removable in any other manner which would not require destruction of the image in the film. There are many ways of accomplishing removability known in the art, but the two preferred means are using dyes which are bleachable in conventional developing solutions, such as those disclosed in *Photographic Chemistry*, Vol. II, P. Glafkides, 1960, pages 703–704. Heat bleaching of the dyes may be accomplished by selecting dyes which are themselves thermolabile or by combining them with materials which can bleach the dyes when heated. The combination of bleachable dyes with nitrate salts capable of liberating $HNO_3$ or nitrogen oxides when heated to 160°–200° C. (as taught in U.S. patent application Ser. No. 199,426 filed Oct. 22, 1980) are particularly desirable.

The dye underlayer is particularly important because it prevents cross-talk within the radiographic element. Cross-talk occurs when light emitted from one screen passes through one silver halide emulsion and the base into the second silver halide emulsion and forms a latent image there. Because the second emulsion (i.e., the emulsion on the side of the base away from the emitting screen under consideration) is relatively far removed from the screen, the light image is greatly dispersed and the resolution would be greatly reduced. It is, therefore, essential that the dye underlayer absorb radiation of the wavelength emitted by the phosphors.

EXAMPLES 1–6

A series of silver halide emulsions with narrow grain size distribution was made in which the grain size was varied from 0.22 to 0.6 micrometers. The emulsions were made using a double jet procedure under controlled pAg conditions. The grains in all cases were iodobromide in composition containing 2.75 mole % iodide and were of cubic habit. The emulsions were handled in the normal manner for coagulating, washing and reconstituting them. The reconstituted emulsions were treated with conventional sulfur and gold sensitizers and were digested at 55° C. to increase their sensitivity, cooled to 40° C., and treated with post sensitization additives and stabilizers (namely, tetraazaindines, additional halides, antifoggants, and a spectral sensitizer chosen to provide maximum sensitivity at 550 nm which matches the maximum emission characteristics of 3M's Trimax ® intensifying screen) as is common to the art.

The photographic films were prepared by separately coating the above emulsion onto both sides of a polyester film base which had previously been coated with an aqueous alkaline soluble dye in a gelatin layer. The film base was 7 mil photograde polyester. The emulsions were applied using a precision photographic coating machine. The final coatings contained 5.1 g $Ag/m^2$.

These films were then exposed to 125 $kV_p$ X-rays at a distance of 48 inches (104 cm) in a cassette containing 3M Trimax ® intensifying screens which are gadolinium, terbium doped oxysulfide phosphor screens. After conventional development, various data were recorded and are shown below in the Table. The noise power was determined by taking a Weiner spectrum (cf. J. Optical Soc. Am. 45, 709–808 (1955)). The results recorded below are given at a frequency of 1 cycle per millimeter in units of microns density.

| Example | Grain size (μm) | Noise Power | MTF |
|---|---|---|---|
| 1 | 0.60 | 14.5 | 0.43 |
| 2 | 0.50 | 15.5 | 0.41 |
| 3 | 0.42 | 13.6 | 0.35 |
| 4 | 0.30 | 7.8 | 0.41 |
| 5 | 0.22 | 7.4 | 0.44 |
| 6 | 0.20 | 4.8 | 0.42 |

The dramatic and unexpected improvement in the reduction in graininess can be seen in the greatly reduced noise level achieved according to the practice of the present invention. Further measurement of the images by modulation transfer function (MTF) at 4 cycles/mm revealed that resolution was not sacrificed in the emulsions with reduced graininess. This means that the information content of the film has been substantially increased.

EXAMPLE 7

This example shows the use of the materials of the present invention in commercial industrial radiographic situations.

Specimen: Two low carbon steel plates joined together with a butt weld. The overall piece measured 12"×8"×1". An ASTM-E142 penetrameter 2.0 was located near the weld joint.

Film: Seven mil polyester coated two sides with a silver iodobromide emulsion optically sensitized to 550 nm. The silver coating weight was 5.4 g/m$^2$. A bleachable dye underlayer was coated on one side. The average grain size was 0.247 microns as determined by electron microscopy.

Screens: Trimax® 12 Front, Trimax® 12 Back

Technique: 300 KVp, 48 inch (122 cm) film-focus-distance, 300 milliamp seconds.

Processing: The exposed film was processed in a Kodak X-OMAT automatic processer in 90 seconds dry-to-dry.

Results: The 2-1T penetrameter hole was clearly visible, indicating an Equivalent Penetrameter Sensitivity of 1.4% as defined in ASTM E142. A small region of incomplete fusion in the weld area was clearly visible.

EXAMPLE 8

This is an example of field radiography using a radioactive isotope source.

Specimen: Steel girder weld, 3.76 cm thick, containing an ASTM-E142 penetrameter, 3.0.

Film: Same as Example 7.

Screens: Trimax® 12 Front, Trimax® 12 Back.

Source: IR-192, 49 curies.

Technique: Film-focus-distance 13.5 inches (34.2 cm) Time 10 seconds.

Process: Exposed film processed in Kodak X-OMAT Type B, 12 minutes dry-to-dry.

Results: The 2-2T penetrameter hole was clearly visible at a density of 1.88. This provides an Equivalent Sensitivity of 2.0 defined in ASTM-E142. A small crack within the weld was also clearly visible.

EXAMPLE 9

This is an example of aluminum radiography.

Specimen: Aluminum stepwedge, 7.5 inches (18.79 cm) in length, 2.75 inches in depth containing 10 steps in 0.25 inch (0.63 cm) increments. The minimum step thickness was 0.5 inches (1.27 cm). Each level of thickness contained the appropriate MIL.STD.271D Al penetrameter.

Film: The film was a silver bromoiodide of average grain size 0.24 microns coated both sides onto seven mil polyester film base. The film base was previously coated one side with a bleachable dye layer. The silver coating weight was 5.7 g/m$^2$.

Screen: Trimax® 2 Front, Trimax® 2 Back.

Technique: 125 KVp, 48 inch (122 cm) film-focus-distance, 40 mas.

Processing: Exposed film was developed in a Kodak X-OMAT automatic processor 90 seconds dry-to-dry.

Results: The 2-1T penetrameter holes were clearly visible on all thicknesses from 0.75 (1.88 cm) to 1.5 inches (3.15 cm) aluminum. This corresponds to an Equivalent Sensitivity of 1.4%.

EXAMPLE 10

This is an example of multiple film radiography.

Specimen: Same as Example 9.

Film: Same as Example 9.

Screens: Trimax 2 Front, Trimax 12F Back.

Procedure: A flexible vinyl cassette is loaded with the two screens and two pieces of film were inserted between the screens.

Technique: 125 KVp, film-focus-distance 44 inches, 30 milliamp seconds.

Processing: The exposed films were developed in a Kodak X-OMAT automatic processor 90 seconds dry-to-dry.

Results: Film No. 1, closest to the X-ray source, clearly revealed the 2-2T penetrameter holes on all thickness between 0.5 (1.27 cm) and 1.2 inches (3.06 cm) aluminum. Film No. 2 clearly revealed the 2-2T penetrameter holes for all thicknesses between 1.2 (3.06 cm) and 2.5 inches (6.26 cm) aluminum. The two films combine to provide an Equivalent Sensitivity of 2% for all steps in the aluminum stepwedge.

The X-ray intensifying screens used in the practice of the present invention are phosphor screens well known in the art. These phosphors are materials which absorb incident X-rays and emit radiation in a different portion of the electromagnetic spectrum, particularly visible and ultraviolet radiation. Calcium tungstate and rare earth (gadolinium and lanthanum) oxysulfides and gadolinium or lanthanum oxybromides are particularly useful phosphors. The gadolinium oxysulfides and the lanthanum oxysulfides and the phosphates and arsenates can be doped to control the emission wavelengths and improve their efficiency. Many of these phosphors are shown in U.S. Pat. No. 3,725,704 and U.K. Pat. No. 1,565,811. The phosphate and arsenate phosphors may be generally represented by the formula $$La_{(1-a-b-c-d-e)}Gd_aCe_bEu_cTb_dTh_eXO_4$$

wherein a is 0.01 to 0.50, b is 0 to 0.50, c is 0 to 0.02, d is o to 0.10, e is 0 to 0.02 and X represents phosphorous or arsenic atoms or mixtures thereof. Preferable, c is 0, a is 0.05 to 0.30 and d is 0 to 0.02. The sum of b, c, d and e should be greater than zero and should most preferably be at least 0.005.

The oxysulfide rare earth phosphors may be represented by the formula $$La_{(2-g-f)}Gd_aLu_hZ_fO_2S$$

wherein Z is the dopant element or elements, g is 0 to 1.99, h is 0 to 1.99 and f is 0.0005 to 0.16. Preferably b is 0, a is 0.15 to 1.00, f is 0.0010 to 0.05 and Z is terbium.

EXAMPLE 11

Film strips were exposed to a varying intensity of light through a rotating sector wheel. The films were identical to those of Example 5, except that the average grain size was 0.24 micrometers with 85% of the grain between 0.20 and 0.28 micrometers. A mirror arrangement was incorporated to provide equal light exposure on both sides of the film strip. The light exposure was filtered to duplicate the output of the rare earth phosphor screen. In the case of Tb doped gadolinium oxysulfide phosphor, the principal light emission was in the blue and green regions of the spectrum. For this corresponding light exposure, a No. 5850 Corning filter was used for the blue exposure. On a separate film strip a similar exposure was made through a No. 5461 optical interference filter to provide the green exposure.

The exposed film strips were processed in a Kodak X-Omat Model SP automatic processor modified to provide 90-second dry-to-dry processing time. The developer temperature was maintained at 95° F. The processing solutions were Kodak RP Developer Replenisher and Kodak RP Fixer and Replenisher. The characteristic curve was generated by measuring the transmission density at known intervals of exposure. Similar characteristic curves were obtained for the blue and green exposures. From the characteristic curves, the following sensitometric properties were obtained:

TABLE 1

| Sensi Property | Blue | Green | Avg. |
|---|---|---|---|
| D-min | 0.13 | 0.13 | 0.13 |
| D-max | 8.6 | 8.6 | 8.6 |
| Contrast at | | | |
| D = 1 | 4.0 | 4.3 | 4.2 |
| D = 2 | 4.7 | 5.4 | 5.1 |
| D = 3 | 5.0 | 6.0 | 5.5 |

Contrast was measured by drawing a straight line tangent to the characteristic curve at the density specified. The ratio of density corresponding to the variation in log exposure provided the contrast value.

Contrast is an important factor in industrial radiography. Contrast values in excess of 4.0 are necessary to detect small differences in specimen thickness, such as small cracks or voids.

Two factors combine in the film of the present invention to provide this unusually high contrast, particularly at low film densities. The first factor is grain size distribution in the silver halide emulsion. With an average grain size of 0.24 microns, 85% of all grains should lie between 0.20 microns and 0.28 microns. This narrow distribution provides a sharp toe to the characteristic curve, together with a very high developed film average contrast.

The second factor contributing to the high contrast is the very high covering power of the small (0.24 micron) silver halide crystal. This high covering power ($D_{max}$ divided by silver coating weight in g/dm$^2$, and which was 430 in this Example) provides very high D-max values for small coating weights of silver halide. The high D-max in Table 1 (8.6) results from a coating weight of 5.0 g/m$^2$ Ag and provides the high contrast values in the higher density regions of the developed film.

In U.S. Pat. No. 4,130,428, the black and white silver halide film (Example 2) would provide radiographs with substantially lower contrast and D-max. The coating contains silver halide grains of 0.6 micron average size and contains the equivalent of 3.8 g/m$^2$ Ag. The stated covering power is 60. Based on these data, the D-max for this film would be 2.28. This film would not have utility in industrial X-ray.

We claim:

1. An industrial radiographic system comprising two high energy particle radiation intensifying screens sandwiching a radiation sensitive element which comprises:

(1) a base, (2) a decolorizable dye underlayer on at least one side of the base, (3) a first black-and-white silver halide emulsion layer over said dye underlayer, and (4) a second black-and-white silver halide emulsion layer on the other side of said base, wherein both of said silver halide emulsion layers are spectrally sensitized to the wavelength of radiation emitted by said screens when struck by high energy particle radiation and wherein the average size of the silver halide grains in the emulsions are below 0.4 micrometers, at least 75% of the total number of grains are within 0.07 micrometers of the average grain size, both emulsions provide a contrast of greater than 4.0 at an optical density of 2.0, and the element can provide $D_{max}$ of at least 3.5.

2. The system of claim 1 wherein said screens are X-ray intensifying screens.

3. The system of claim 2 wherein the average grain size is between 0.075 and 0.35 micrometers.

4. The system of claim 2 wherein the emulsions are sensitized by at least one sensitizing dye so that the maximum sensitivity of the emulsions is within 50 nanometers of the maximum intensity wavelength emission of the screens.

5. The system of claim 4 wherein said maximum sensitivity is within 25 nanometers of the maximum intensity wavelength emission of the screens.

6. A process for the non-destructive testing of industrial materials which comprises placing an industrial material between a controlled X-ray source and the radiographic system of claim 2, directing X-rays from the source through the industrial material and into said radiographic system at an angle approximately perpendicular to said intensifying screens to generate a latent image in said first and second silver halide imaging layers.

7. The system of claim 2 wherein the phosphors of said screens comprise gadolinium oxysulfides, lathanum oxysulfides, gadolinium-lanthanum oxysulfides, gadolinium oxybromides, lanthanum oxybromides, or lanthanum-gadolinium oxybromides.

8. The system of claim 3 wherein the emulsions are sensitized by at least one sensitizing dye so that the maximum sensitivity of the emulsions is within 50 nanometers of the maximum intensity wavelength emission of the screens.

9. The system of claim 3 wherein the phosphors of said screens comprise gadolinium oxysulfides, lathanum oxysulfides, gadolinium-lanthanum oxysulfides, gadolinium oxybromides, lanthanum oxybromides, or lanthanum-gadolinium oxybromides.

* * * * *